US005837648A

United States Patent [19]

Tatehana et al.

[11] Patent Number: 5,837,648

[45] Date of Patent: Nov. 17, 1998

[54] THERMAL TRANSFER SHEET, THERMAL TRANSFER METHOD USING THE SAME, AND THERMALLY TRANSFERRED PRODUCT

[75] Inventors: Atsushi Tatehana; Jiro Onishi; Katsuyuki Oshima, all of Tokyo-To, Japan

[73] Assignee: Dai Nippon Printing Co., Ltd., Japan

[21] Appl. No.: 649,004

[22] Filed: May 16, 1996

[30] Foreign Application Priority Data

May 18, 1995 [JP] Japan ..... 7-143888

[51] Int. Cl.[6] ..... B41M 5/035; B41M 5/38

[52] U.S. Cl. ..... 503/227; 428/195; 428/913; 428/914

[58] Field of Search ..... 8/471; 428/195, 428/913, 914; 503/227

[56] References Cited

U.S. PATENT DOCUMENTS 4,738,555 4/1988 Nagashima ..... 400/240
5,175,139 12/1992 Nakamura et al. ..... 503/227
5,332,713 7/1994 Oldfield et al. ..... 503/227

FOREIGN PATENT DOCUMENTS 0 550 817 A2 7/1993 European Pat. Off. ..... 503/227
0 672 541 A1 9/1995 European Pat. Off. ..... 503/227
0 687 574 A2 12/1995 European Pat. Off. ..... 503/227

*Primary Examiner*—Bruce H. Hess
*Attorney, Agent, or Firm*—Parkhurst & Wendel, L.L.P.

[57] ABSTRACT

A thermal transfer sheet is provided which can thermally transfer an excellent image capable of maintaining various types of durability, various types of fastness, particularly weather resistance and the like for a long period of time. The thermal transfer sheet comprises: a substrate film; a sublimable black dye layer and a transferable protective layer provided on the substrate film in a face serial manner, the sublimable black dye layer comprising a mixture of particular yellow, magenta, and cyan dyes. A thermal transfer method using such a thermal transfer sheet is also disclosed.

10 Claims, 1 Drawing Sheet

THERMAL TRANSFER SHEET, THERMAL TRANSFER METHOD USING THE SAME, AND THERMALLY TRANSFERRED PRODUCT

TECHNICAL FIELD

The present invention relates to a thermal transfer sheet, a thermal transfer method using the same, and a thermally transferred product. More particularly, the present invention relates to a thermal transfer sheet, which can form a black image, such as a letter, a mark, or a figure, having high sharpness, particularly excellent expression of gradation, and excellent durability on the surface of cards represented by identification cards, a thermal transfer method using the same, and a thermally transferred product.

BACKGROUND OF THE INVENTION

Regarding the formation of an image by thermal transfer recording, a sublimation type thermal recording system and a hot-melt type thermal recording system are generally known in the art.

In the former system, a transfer sheet comprising a substrate film bearing a dye layer containing a sublimable dye is used, and the dye component is thermally transferred by heating means represented by a thermal head to conduct recording. On the other hand, in the latter system, a transfer sheet comprising a hot-melt ink layer containing a colorant, such as a pigment, and a vehicle, such as wax, is used, and the hot-melt ink layer is softened and transferred by the same means as described above to form an image.

These methods for the formation of an image by thermal transfer recording can simply prepare various images and are utilized in various fields, for example, in order to obtain a hard copy from information stored in a video tape.

In recent years, an attempt to utilize the formation of an image by thermal transfer recording has been made in the preparation of high-quality prints wherein the number thereof may be relatively small.

For example, studies have been made on the utilization of the above thermal transfer recording in the formation of images, such as letters, marks, or figures, on the surface of cards represented by identification cards.

In the case of the preparation of cards or the like utilizing the formation of an image by thermal transfer recording, when the sublimation type thermal recording system is used, an image, such as a photograph-like image of a face, having excellent tone reproduction can be formed by regulating thermal energy supplied at the time of transfer operation. In the formation of single color images, such as letters and marks, however, the sublimation type thermal recording system has problems associated with density and sharpness of the image, making it difficult to form satisfactory images.

Further, unlike the formation of an image using a conventional printing ink, the formation of an image by the sublimation type thermal recording system is carried out by taking advantage of the thermal transfer of a dye. Therefore, the image formed by the sublimation type thermal recording system is free from a component such as a vehicle and, hence, is unsatisfactory in durability and fastness, such as light fastness, weather resistance, abrasion resistance, and chemical resistance.

On the other hand, the hot-melt type thermal recording system can form relatively good images when contemplated images are monotonous images, such as letters and numerals. It, however, has a drawback that the formation of images having gradations of tone is very difficult.

Accordingly, an object of the present invention is to solve the above problems of the prior art and to provide a thermal transfer sheet, a thermal transfer method and the like which can form excellent thermally transferred images capable of maintaining various types of durability and various types of fastness, particularly weather resistance or the like for a long period of time.

The present inventors have made extensive and intensive studies with a view to solving the above problems and, as a result, have found that thermally transferred images, such as letters, marks, figures or photograph-like images of a face or the like, having high color density, excellent vividness and sharpness, and excellent durability, various types of fastness and other properties, can be formed by selecting specific dyes from known yellow, magenta, and cyan dyes, using them in combination to prepare a black ink composition, containing the mixture of these selected dyes, providing a sublimable black dye layer using the black ink composition on a substrate film, providing a transferable protective layer, in parallel to the sublimable black dye layer in a face serial manner, for protecting a thermally transferred image in order to improve various types of durability, various types of fastness and other properties, thereby preparing a thermal transfer sheet, and forming an image using this thermal transfer sheet on an image-receiving sheet, which has led to the completion of the present invention.

Thus, the present invention relates to a thermal transfer sheet comprising: a substrate film; and a sublimable black dye layer and a transferable protective layer provided on the substrate film in a face serial manner, the sublimable black dye layer comprising at least one yellow dye selected from specific yellow dyes, at least one magenta dye selected from specific magenta dyes, and at least one cyan dye selected from specific cyan dyes, and a thermal transfer method using the same and a thermally transferred product.

According to the present invention, black images, such as letters, marks, figures, or photograph-like images of a face, can be formed by selecting specific dyes from yellow, magenta, and cyan dyes, using them in combination to prepare a black ink composition containing the mixture of these selected dyes, providing a sublimable black dye layer using the black ink composition, and applying heat to only the sublimable black dye layer.

Since the above black image is based on the thermal transfer of a dye by sublimation or melting, it is relatively poor in durability and various types of fastness, such as light fastness, weather resistance, abrasion resistance, and chemical resistance. For this reason, according to the present invention, a transferable protective layer is thermally transferred onto the image to protect the image, thereby enabling the formation of an image having excellent durability and various types of fastness.

BEST MODE FOR CARRYING OUT INVENTION

The construction of the thermal transfer sheet according to the present invention and a process for producing such a thermal transfer sheet will be described.

Figure 1:
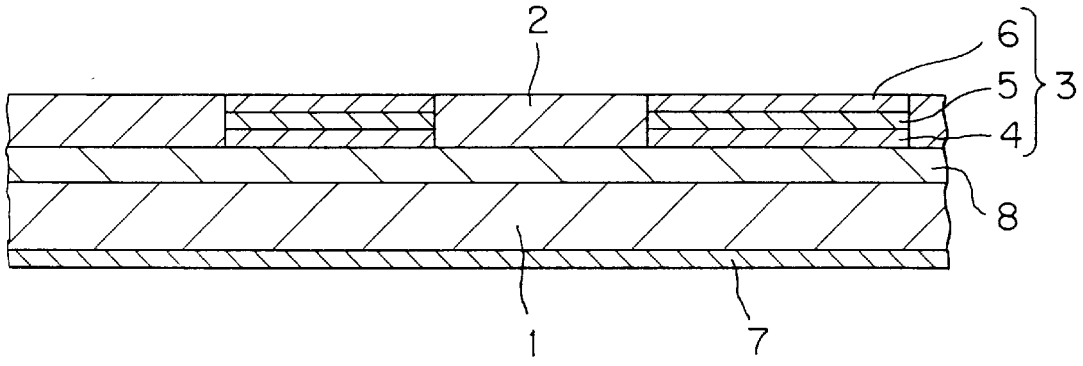
FIG. 1 is a schematic cross-sectional view of an embodiment of the thermal transfer sheet according to the present invention.
Figure 2:
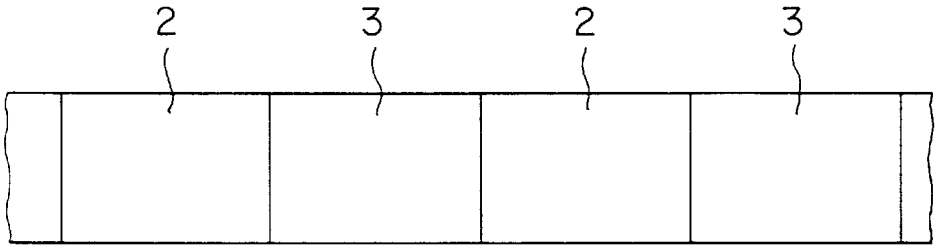
FIG. 2 is a schematic plan view of the thermal transfer sheet shown in FIG. 1.

FIG. 1 is a schematic cross-sectional view showing one embodiment of the construction of the thermal transfer sheet according to the present invention, and FIG. 2 is a plan view of the thermal transfer sheet shown in FIG. 1.

As shown in FIGS. 1 and 2, one embodiment of the thermal transfer sheet according to the present invention comprises: a substrate film 1; and, provided on the substrate film in a face serial manner, a sublimable black dye layer 2 and a transferable protective layer 3 comprising a release layer 4, a protective layer 5, and an adhesive layer 6 laminated in that order on top of one another.

In the drawing, numeral 7 designates a heat-resistant slip layer which functions to prevent sticking of the thermal transfer sheet to a thermal head of a printer.

Numeral 8 designates a primer layer which functions to improve the adhesion of the sublimable black dye layer 2 and the transferable protective layer 3 to the substrate film 1.

In thermal transfer sheet of the present invention, the substrate film may be any one so far as it can hold the sublimable black dye layer and the transferable protective layer, and examples thereof include: thin paper, such as glassine paper, capacitor paper, and paraffin paper; films or sheets of natural and synthetic resins, such as polyethylene terephthalate, polyethylene, polypropylene, polycarbonate, polyvinyl chloride, polyvinylidene chloride, polystyrene, polyamide, polyimide, and cellulose acetate; cellophane films; and other films.

The thickness of the substrate film may be such that strength high enough to hold the sublimable black dye layer and the transferable protective layer and heat resistance are ensured. Although it may be suitably varied according to the type of the material used as the substrate film, a thickness of about 3 to 100 $\mu$m is generally preferred.

In the present invention, the sublimable black dye layer may be constructed by selecting specific yellow, magenta, and cyan dyes from known yellow, magenta, and cyan dyes, using them in combination to prepare a black ink composition containing the mixture of these selected dyes, and forming a sublimable black dye layer using the black ink composition on a substrate film.

The yellow dye incorporated into the sublimable black dye layer may be at least one member selected from yellow dyes represented by the following general formulae (1), (2), and (3):

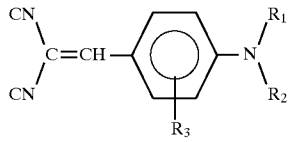

(1)

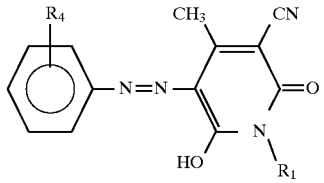

(2)

-continued

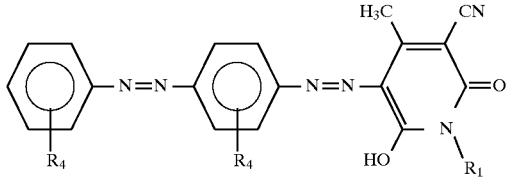

(3)

In the general formula (1), $R_1$ and $R_2$ each independently represent a substituted or unsubstituted alkyl, substituted or unsubstituted allyl, substituted or unsubstituted aryl, substituted or unsubstituted cycloalkyl, or substituted or unsubstituted aralkyl group.

Specific examples of $R_1$ and $R_2$ include ethyl, 4-cyclohexyl phenoxyethyl, n-butyl, phenyl, 2-propenyl, and benzyl groups. Among them, an ethyl group is particularly preferred as $R_1$, and a 4-cyclohexyl phenoxyethyl group is particularly preferred as $R_2$.

In the general formula (1), $R_3$ represents a hydrogen or halogen atom, substituted or unsubstituted alkyl, substituted or unsubstituted alkylcarbonylamino, substituted or unsubstituted alkylsulfonylamino, substituted or unsubstituted alkoxy, cyano, or nitro group or a halogen or hydrogen atom.

Specific examples of $R_3$ include a chlorine atom, methyl, ethyl, acetylamino, ethylsulfonylamino, and ethoxy groups. Among them, for example, 3-$CH_3$ (a methyl group attached to the atom located at the 3-position of the ring) is particularly preferred.

The number of substituents represented by $R_3$ may be in principle any possible one, i.e., in the range of 1 to 4.

In the general formula (2), $R_1$ represents a substituted or unsubstituted alkyl, substituted or unsubstituted aryl, substituted or unsubstituted allyl, or substituted or unsubstituted aralkyl group.

Specific examples of $R_1$ include ethyl, n-butyl, phenyl, 2-propenyl, and benzyl groups. Among them, n-$C_4H_9$ (n-butyl group) is particularly preferred.

In the general formula (2), $R_4$ represents a substituted or unsubstituted alkyl, substituted or unsubstituted aralkyloxycarbonyl, substituted or unsubstituted alkoxycarbonyl, substituted or unsubstituted alkylaminocarbonyl, substituted or unsubstituted alkoxy, substituted or unsubstituted alkylaminosulfonyl, substituted or unsubstituted cycloalkyl, cyano, or nitro group, or a halogen or hydrogen atom.

Specific examples of $R_4$ include a chlorine atom and phenylmethoxycarbonyl, ethoxycarbonyl, methoxy, and ethyl groups. Among them, a phenylmethoxycarbonyl group attached to the atom located at the 4-position of the ring is particularly preferred.

The number of substituents represented by $R_4$ may be in principle any possible one, i.e., in the range of 1 to 5.

In the general formula (3), $R_1$ represents a substituted or unsubstituted alkyl, substituted or unsubstituted aryl, substituted or unsubstituted allyl, substituted or unsubstituted aralkyl, or substituted or unsubstituted alkoxyalkyl group.

Specific examples of $R_1$ include methyl, n-butyl, phenyl, 2-propenyl, benzyl, and —$CH_2CH_2CH_2OCH(CH_3)_2$. Among them, —$CH_2CH_2CH_2OCH(CH_3)_2$ is particularly preferred.

In the general formula (3), $R_4$ represents a substituted or unsubstituted alkyl, substituted or unsubstituted aralkyloxycarbonyl, substituted or unsubstituted alkoxycarbonyl, substituted or unsubstituted alkylaminocarbonyl, substituted or unsubstituted alkoxy, substituted or unsubstituted alkylaminosulfonyl, substituted or unsubstituted cycloalkyl, cyano, or nitro group, or a halogen or hydrogen atom.

Specific examples of $R_4$ include methyl and cyano groups and chlorine and hydrogen atoms. Among them, a hydrogen atom is particularly preferred as $R_4$.

The content of the above yellow dye in the dye composition of the black dye layer is preferably 5 to 50% by weight, more preferably 10 to 40% by weight. When the content is outside the above range, the color does not become black although a some change in composition results in no remarkable deterioration in storage stability.

The magenta dye incorporated into the sublimable black dye layer according to the present invention may be at least one member selected from magenta dyes represented by the following general formulae (4), (5), and (6):

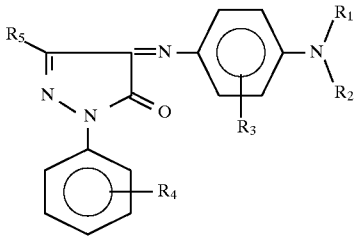

(4)

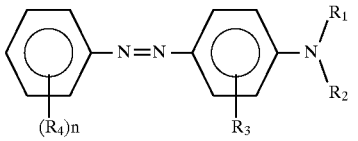

(5)

(wherein n is an integer of 3 or less)

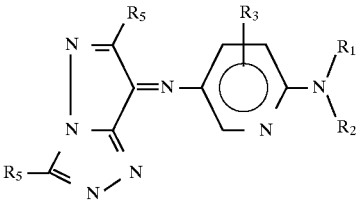

(6)

In the general formula (4), $R_1$ and $R_2$ represent a substituted or unsubstituted alkyl, substituted or unsubstituted allyl, substituted or unsubstituted aryl, substituted or unsubstituted cycloalkyl, or substituted or unsubstituted aralkyl group.

Specific examples of $R_1$ and $R_2$ include ethyl, n-butyl, phenyl, cyclohexyl, 2-propenyl, and benzyl groups. Among them, an ethyl group is particularly preferred as $R_1$ and $R_2$.

In the general formula (4), $R_3$ represents a substituted or unsubstituted alkyl, substituted or unsubstituted alkoxy, substituted or unsubstituted alkylcarbonylamino, substituted or unsubstituted alkylsulfonylamino, or substituted or unsubstituted alkylaminocarbonyl group.

Specific examples of $R_3$ include methyl, ethyl, and methoxy groups, —$CONHC_3H_7$, —$NHCOCH_3$, and —$NHSO_2CH_3$. Among them, a methyl group is particularly preferred as $R_3$.

In the general formula (4), $R_4$ represents a substituted or unsubstituted alkyl, substituted or unsubstituted aralkyloxycarbonyl, substituted or unsubstituted alkoxycarbonyl, substituted or unsubstituted alkylaminocarbonyl, substituted or unsubstituted alkoxy, substituted or unsubstituted alkylaminosulfonyl, substituted or unsubstituted cycloalkyl, cyano, or nitro group, or a halogen or hydrogen atom.

Specific examples of $R_4$ include a hydrogen atom, a methyl group, —$NHCOCH_3$, and —$NHSO_2CH_3$. Among them, a hydrogen atom is particularly preferred as $R_4$.

In the general formula (4), $R_5$ represents a substituted or unsubstituted alkyl, substituted or unsubstituted aryl, substituted or unsubstituted amino, substituted or unsubstituted cycloalkyl, cyano, or nitro group, or a halogen or hydrogen atom.

Specific examples of $R_5$ include methyl, ethyl, and phenyl groups. Among them, a methyl group is particularly preferred as $R_5$.

In the general formula (5), $R_1$ and $R_2$ represent a substituted or unsubstituted alkyl, substituted or unsubstituted allyl, substituted or unsubstituted aryl, substituted or unsubstituted cycloalkyl, or substituted or unsubstituted aralkyl group.

Specific examples of $R_1$ and $R_2$ include ethyl, n-butyl, phenyl, 2-propenyl, and benzyl groups. Among them, ethyl and benzyl groups are particularly preferred as $R_1$, and ethyl and 2-propenyl groups are particularly preferred as $R_2$.

In the general formula (5), $R_3$ represents a substituted or unsubstituted alkyl, substituted or unsubstituted alkoxy, substituted or unsubstituted alkylcarbonylamino, substituted or unsubstituted alkylsulfonylamino, or substituted or unsubstituted alkylaminocarbonyl group.

Specific examples of $R_3$ include methyl, ethyl, and methoxy groups, —$NHCOCH_3$, and —$NHSO_2CH_3$. Among them, —$NHSO_2CH_3$ and —$NHCOCH_3$ are particularly preferred as $R_3$.

In the general formula (5), $R_4$ represents a substituted or unsubstituted alkyl, substituted or unsubstituted aralkyloxycarbonyl, substituted or unsubstituted alkoxycarbonyl, substituted or unsubstituted alkylaminocarbonyl, substituted or unsubstituted alkoxy, substituted or unsubstituted alkylaminosulfonyl, substituted or unsubstituted cycloalkyl, cyano, or nitro group, or a halogen or hydrogen atom.

Specific examples of $R_4$ include methyl, ethyl, methoxy, and cyclohexyl groups, —$SO_2NHCH_3$, cyano and nitro groups, and chlorine and hydrogen atoms. Among them, a methyl, cyano, and nitro groups and a chlorine atom are particularly preferred as $R_4$.

In the general formula (6), $R_1$ and $R_2$ represent a substituted or unsubstituted alkyl, substituted or unsubstituted allyl, substituted or unsubstituted aryl, substituted or unsubstituted cycloalkyl, or substituted or unsubstituted aralkyl group.

Specific examples of $R_1$ and $R_2$ include ethyl, n-butyl, phenyl, cyclohexyl, 2-propenyl, and benzyl groups. Among them, an ethyl group is particularly preferred as $R_1$ and $R_2$.

In the general formula (6), $R_3$ represents a substituted or unsubstituted alkyl, substituted or unsubstituted alkoxy, substituted or unsubstituted alkylcarbonylamino, substituted or unsubstituted alkylsulfonylamino, or substituted or unsubstituted alkylaminocarbonyl group.

Specific examples of $R_3$ include methyl, ethyl, and methoxy groups, —$NHCOCH_3$, and —$NHSO_2CH_3$. Among them, a methyl group is particularly preferred as $R_3$.

In the general formula (6), $R_5$ represents a substituted or unsubstituted alkyl, substituted or unsubstituted aryl, substituted or unsubstituted amino, substituted or unsubstituted cycloalkyl, cyano, or nitro group, or a halogen or hydrogen atom.

Specific examples of $R_5$ include methyl, phenyl, 3-methylphenyl, and tert-butyl groups. Among them, 3-methylphenyl and tert-butyl group are particularly preferred as $R_5$.

The content of the above magenta dye in the dye composition of the black dye layer is preferably 5 to 50% by weight, more preferably 10 to 40% by weight. When the content is outside the above range, the color does not become black although a some change in composition results in no remarkable deterioration in storage stability, as in the case of the yellow dye.

The cyan dye incorporated into the sublimable black dye layer according to the present invention may be at least one member selected from cyan dyes represented by the following general formulae (7), (8), and (9):

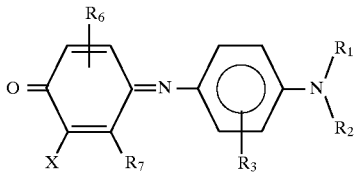

(7)

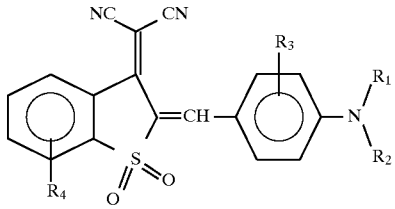

(8)

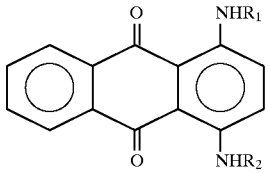

(9)

In the general formula (7), $R_1$ and $R_2$ each independently represent a substituted or unsubstituted alkyl, substituted or unsubstituted allyl, substituted or unsubstituted aryl, substituted or unsubstituted cycloalkyl, or substituted or unsubstituted aralkyl group.

Specific examples of $R_1$ and $R_2$ include ethyl, n-butyl, 2-propenyl, and benzyl groups. Among them, an ethyl group is particularly preferred as $R_1$ and $R_2$.

In the general formula (7), $R_3$ represents a substituted or unsubstituted alkyl, substituted or unsubstituted alkylcarbonylamino, substituted or unsubstituted alkylsulfonylamino, substituted or unsubstituted alkoxy, cyano, or nitro group or a halogen or hydrogen atom.

Specific examples of $R_3$ include a hydrogen atom, a methyl group, —$NHCOCH_3$, and —$NHSO_2CH_3$. Among them, a methyl group and a hydrogen atom are particularly preferred as $R_3$.

In the general formula (7), $R_6$ represents a substituted or unsubstituted alkylaminocarbonyl, substituted or unsubstituted alkylaminosulfonyl, substituted or unsubstituted alkylcarbonylamino, or substituted or unsubstituted alkylsulfonylamino group or a halogen atom.

Specific examples of $R_6$ include —$CONHCH_3$, —$SO_2NHCH_3$, $NHCOC_2H_5$, —$NHCOC_3H_7$, and —$NHSO_2CH_3$. Among them, —$NHCOCH_3$, —$NHCOC_2H_5$, and —$NHCOC_3H_7$ are particularly preferred as $R_6$.

In the general formula (7), $R_7$ represents a substituted or unsubstituted alkyl, cyano, or nitro group, or a halogen or hydrogen atom.

Specific examples of $R_7$ include methyl and ethyl groups and chlorine and hydrogen atoms. Among them, a methyl group and a hydrogen atom are particularly preferred as $R_7$.

In the general formula (7), X represents a halogen or hydrogen atom.

In the general formula (8), $R_1$ and $R_2$ represent a substituted or unsubstituted alkyl, substituted or unsubstituted aryl, substituted or unsubstituted cycloalkyl, or substituted or unsubstituted aralkyl group.

Specific examples of $R_1$ and $R_2$ include n-butyl, n-hexyl, phenyl, 2-propenyl, and benzyl groups. Among them, n-$C_6H_{13}$ (n-hexyl group) is particularly preferred as $R_1$ and $R_2$.

In the general formula (8), $R_3$ represents a substituted or unsubstituted alkyl, substituted or unsubstituted alkoxy, substituted or unsubstituted alkylcarbonylamino, substituted or unsubstituted alkylsulfonylamino, or substituted or unsubstituted alkylaminocarbonyl group.

Specific examples of $R_3$ include a chlorine atom, methyl, ethyl, acetylamino, ethylsulfonylamino, and ethoxy groups. Among them, 3-$CH_3$ (a methyl group attached to the atom located at the 3-position of the ring) is particularly preferred. The number of substituents represented by $R_3$ may be in principe any possible one, i.e., in the range of 1 to 4.

In the general formula (8), $R_4$ represents a substituted or unsubstituted alkyl, substituted or unsubstituted aralkyloxycarbonyl, substituted or unsubstituted alkoxycarbonyl, substituted or unsubstituted alkylaminocarbonyl, substituted or unsubstituted alkoxy, substituted or unsubstituted alkylaminosulfonyl, substituted or unsubstituted cycloalkyl, cyano, or nitro group or a halogen or hydrogen atom.

Specific examples of $R_4$ include methyl, ethyl, —$CONHCH_3$, —$SO_2NHCH_3$, cyano and nitro groups, and halogen and hydrogen atoms. Among them, a hydrogen atom is preferred as $R_4$.

In the general formula (9), $R_1$ and $R_2$ each independently represent a substituted or unsubstituted alkyl, substituted or unsubstituted allyl, substituted or unsubstituted aryl, substituted or unsubstituted cycloalkyl, or substituted or unsubstituted aralkyl group.

Specific examples of $R_1$ and $R_2$ include methyl, 3-methylphenyl, n-butyl, phenyl, 2-propenyl, and benzyl groups. Among them, —$CH_3$ (a methyl group) is particularly preferred as $R_1$, and a 3-methylphenyl group is particularly preferred as $R_2$.

The content of the above cyan dye in the dye composition of the black dye layer is preferably 30 to 75% by weight, more preferably 40 to 70% by weight. When the content is outside the above range, the color does not become black although a some change in composition results in no remarkable deterioration in storage stability, as in the case of the yellow and magenta dyes.

According to the present invention, in the above yellow, magenta, and cyan dyes, the use of a combination of yellow, magenta, and cyan dyes represented by the respective formulae Y-2, M-4, C-1, and C-4 is most preferred. This combination can advantageously provide high sensitivity in printing of an image and enables an image having no significant gradation color difference and an excellent color reproduction to be formed.

Y-2 (C.I. Disperse Yellow 201)

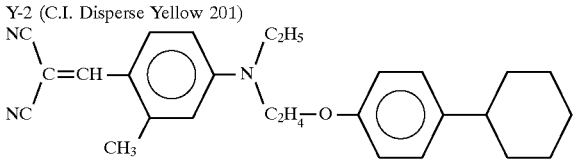

-continued

M-4

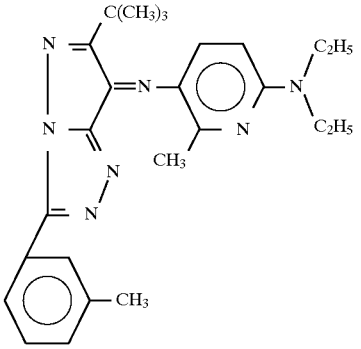

C-1

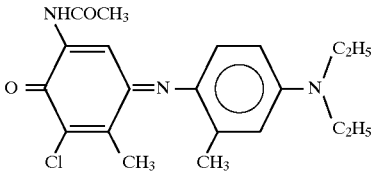

C-4 (C.I. Solvent Blue 63)

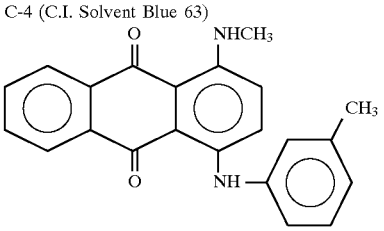

The black dye layer contains a binder in combination with the above dyes.

The binder may be any conventional resin binder.

Specific examples thereof include cellulosic resins, such as ethyl cellulose, hydroxyethyl cellulose, ethyl hydroxyethyl cellulose, hydroxypropyl cellulose, methyl cellulose, cellulose acetate, and cellulose butyrate, vinyl resins, such as polyvinyl alcohol, polyvinyl chloride, polyacrylic resin, polyvinyl acetate, polyvinyl butyral, polyvinyl acetal, polyvinyl acetoacetal, polyvinyl pyrrolidone, and polyacrylamide, polyester, polyamide, polyurethane, polyaminoplast resin, phenolic resin, and epoxy resin.

Among them, cellulosic, acetal, butyral, and polyester binders are particularly preferred from the viewpoints of heat resistance and transferability of dye.

Further, in the present invention, the so-called "releasable graft copolymer" may be used as the binder.

The releasable graft copolymer may also be used as a release agent which will be described below.

The releasable graft copolymer is a polymer wherein at least one releasable segment selected from a polysiloxane segment, a fluorocarbon segment, and a long-chain alkyl segment is grafted onto a polymer backbone.

The releasable graft copolymer may be synthesized by various methods. One example of preferred methods for synthesizing the releasable graft copolymer is that, after the formation of a polymer backbone, a functional group present in the polymer backbone is reacted with a releasable compound having a functional group reactive with the above functional group.

Polymers having good storage stability and compatibility, for example, acrylic, acrylamide, polyester, polyurethane, polyamide, diene, and epoxy resins may be used as the polymer backbone.

Examples of the releasable compound having a functional group include polysiloxane compounds represented by the following formulae (10) to (16). Among them, polysiloxane compounds, having in its structure a —NCO group, represented by the formula (14) are most preferred.

In the formulae, a part of the methyl groups may be substituted with other alkyl group or an aromatic group, such as a phenyl group.

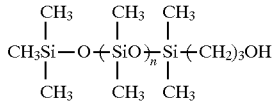

(10)

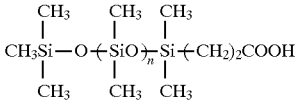

(11)

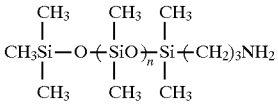

(12)

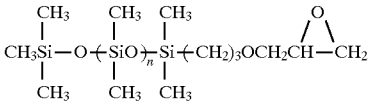

(13)

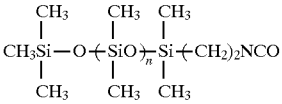

(14)

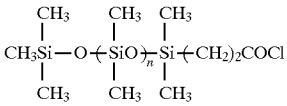

(15)

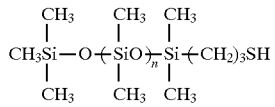

(16)

Additional examples of the releasable compounds having a functional group usable herein include fluorocarbon compounds represented by the following formulae (17) to (27).

$$C_8F_{17}C_2H_4OH \quad (17)$$

$$C_6F_{13}C_2H_4OH \quad (18)$$

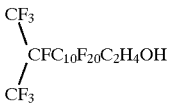

(19)

$$C_9F_{19}C_2H_4OH \quad (20)$$

$$C_{10}F_{21}C_2H_4OH \quad (21)$$

$$C_8F_{17}SO_2N(C_2H_5)C_2H_4OH \quad (22)$$

$$C_8F_{17}CON(C_2H_5)C_2H_4OH \quad (23)$$

$$C_6F_{13}COOH \quad (24)$$

$$C_6F_{13}COCl \quad (25)$$

$$C_8F_{17}C_2H_4SH \quad (26)$$

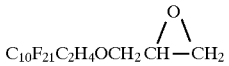

(27)

Further examples of the releasable compounds having a functional group usable herein include long-chain alkyl compounds.

Specific examples of the long-chain alkyl compound include higher fatty acids, such as lauric acid, myristic acid, palmitic acid, stearic acid, oleic acid, and linolic acid, and acid halides thereof, higher alcohols, such as nonyl alcohol, capryl alcohol, lauryl alcohol, myristyl alcohol, cetyl alcohol, stearyl alcohol, oleyl alcohol, linoleyl alcohol, and ricinoleyl alcohols, higher aldehydes, such as capric aldehyde, lauric aldehyde, myristic aldehyde, and stearic aldehyde, and higher amines, such as decylamine, laurylamine, or cetylamine.

These examples are given for illustrative purposes only, and the releasable compounds having a functional group are not limited to the above compounds.

In the present invention, the releasable compound having a functional group is preferably a monofunctional releasable compound having one functional group per molecule. The use of a difunctional releasable compound is unfavorable because the resultant graft copolymer is likely to gel.

In the present invention, the releasable graft copolymer may be prepared by another production method which comprises reacting the above releasable compound having a functional group with a vinyl compound having a functional group reactive with the above functional group to prepare a monomer having a releasable segment and copolymerizing the monomer with various other vinyl monomers.

A further method for producing the releasable graft copolymer is that, for example, a mercapto compound or a releasable vinyl compound may be added and grafted onto a polymer having an unsaturated double bond in its backbone, such as an unsaturated polyester or a copolymer of a vinyl monomer with a diene compound such as butadiene.

In the present invention, polyvinyl acetal, polyacrylic, polyvinyl, polyester, polyurethane, polyamide, and cellulosic resins are particularly preferred as the polymer backbone from the viewpoint of compatibility with other binder resins and/or affinity for dyes.

Among the above resins, a polyvinyl acetal resin is particularly preferred.

The polyvinyl acetal is referred to polyvinyl formal when the acetal portion is formaldehyde; polyvinyl acetoacetal when the acetal portion is acetaldehyde; and polyvinyl butyral when the acetal portion is butylaldehyde. In the present invention, the "polyvinyl acetal" embraces all of these acetals unless otherwise specified.

In the present invention, the preparation of a graft polymer by grafting a polysiloxane segment onto a backbone of a polyvinyl acetal, as described above, may be performed, for example, by reacting a polysiloxane having a functional group with a diisocyanate to prepare a silicone chain for grafting and grafting the silicone chain onto a polyvinyl acetal.

More specifically, for example, a silicone chain for grafting may be prepared by reacting hexamethylene diisocyanate with a dimethylpolysiloxane having a hydroxyl group in its one end in a 1:1 mixture, as a solvent, of methyl ethyl ketone and methyl tributyl ketone in the presence of 0.01 to 1.0% by weight of a tin-base catalyst, for example, dibutyltin, at a reaction temperature of about 50° to 100° C.

Thereafter, the silicone chain for grafting may be reacted with a polyvinyl acetal resin in a 1:1 mixture, as a solvent, of methyl ethyl ketone and methyl isobutyl ketone to give a silicone-grafted polyvinyl acetal resin.

In the present invention, polyvinyl acetoacetal and polyvinyl butyral are preferably used as the polymer backbone.

The polyvinyl butyral is preferably one represented by the following formula (28) and having a hydroxyl content (m) of 5 to 40% by weight, preferably 14 to 36% by weight, and a degree of polymerization of 700 to 2400, preferably about 1700 to 2400.

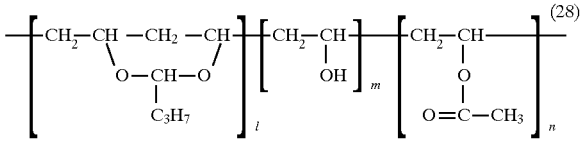

(28)

wherein l, m, and n are the content ratio (wt %) of units in the polymer.

In the present invention, examples of the polysiloxane chain to be grafted onto the polymer backbone include those siloxanes which are represented by the formula (29), have a molecular weight of 1000 to 2500, preferably 1500 to 2000, a degree of polymerization of the siloxane chain n of 3 to 48, preferably 8 to 18, and a conversion to polyvinyl butyral as the backbone of 0.1 to 40% by weight, preferably 1 to 10% by weight.

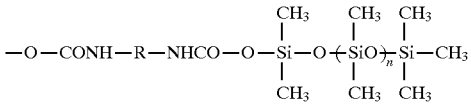

(29)

wherein R represents a substituted or unsubstituted methylene group, such as hexamethylene, and n represents the degree of polymerization of the siloxane chain.

The conversion is defined by the following equation.

Conversion=[Siloxane chain (weight)/(backbone butyral (weight)+siloxane chain (weight))]×100 (%)

When the graft copolymer is used as the binder for the black dye layer, the content of the releasable segment in the binder resin is preferably such that 0.5 to 40% by weight of the binder resin is accounted for by the releasable segment. When the amount of the releasable segment is excessively small, the releasability of the dye layer is unsatisfactory. On the other hand, when it is excessively large, the thermal transferability of the dye in the dye layer and the coating strength are deteriorated and, further, discoloration of the dye in the dye layer and a problem associated with storage stability of the thermal transfer sheet unfavorably occur.

According to the present invention, the above yellow, magenta, and cyan dyes and binder are selected and used in combination to prepare a black ink composition for constituting a black dye layer.

In the present invention, however, other additives may be used in the preparation of the black ink composition.

Conventional additives, for example, plasticizers, stabilizers, antioxidants, light stabilizers, ultraviolet absorbers, lubricants, antistatic agents, and fillers, may be suitably added to prepare the black ink composition.

In the present invention, when the thermal transfer sheet is put on top of an image-receiving sheet described below and heat is applied to conduct printing, the dye layer preferably has releasability. For this reason, in the preparation of the black ink, the addition of a release agent to the ink composition is preferred.

Examples of release agents usable herein include silicone resin, fluororesin, polyethylene wax, waxes, and other organic release agents and inorganic release agents, such as inorganic fillers.

According to the present invention, the above releasable graft copolymer may be used as the release agent.

When the releasable graft copolymer is used as the release agent, the content of the releasable segment in the releasable graft copolymer is preferably in the range of from 10 to 80% by weight. When the content of the releasable segment is excessively low, the releasability becomes unsatisfactory. On the other hand, when it is excessively high, the compatibility with the binder is deteriorated, unfavorably posing a problem associated with the transferability of the dye.

When the releasable graft copolymers are added to the dye layer, they may be added either alone or as a mixture of two or more. The amount of the releasable copolymer added is preferably about 1 to 40 parts by weight based on 100 parts by weight of the binder resin.

When it is excessively small, the release effect is unsatisfactory. On the other hand, when it is excessively large, the transferability of the dye in the dye layer and the coating strength are deteriorated and, further, discoloration of the dye in the dye layer and an additional problem associated with the storage stability of the thermal transfer sheet unfavorably occur.

Further, in the present invention, preferably, the dye layer is provided, by double coating, that is, so as to have a two-layer structure, and the dye layer in contact with the receptive layer contains a larger amount of the release binder as described above than the dye layer on the substrate side.

This can improve the transferability of the dye onto the receptive layer at the time of heat printing and, at the same time, can maintain the adhesion between the substrate and the dye layer.

In addition, a large coverage of the dye layer may be ensured enabling a dye image having a good density to be formed.

In the present invention, the proportions of the dye and the binder in the black ink composition, that is, the ratio of the dye to the binder in the black ink composition (D/B ratio wherein D represents the weight of the dye and B represents the weight of the binder) may be in a wide range of from about 0.5 to 3.0.

Even in such a wide range of ratio, according to the purposes, a desired print density can be provided, and the storage stability of the transfer sheet can be enhanced.

In the present invention, the black dye layer may be generally formed by mixing the above dyes, the binder resin, and other optional ingredients together to prepare a coating liquid (an ink composition) as a solution or a dispersion, coating the coating liquid onto a substrate film, for example, by gravure coating, roll coating or other coating means, and drying the coating to form a black dye layer.

The thickness of the black dye layer thus formed is preferably 0.1 to 10 $\mu$m, more preferably about 0.2 to 3.0 $\mu$m.

The content of the dye in the black dye layer is preferably 20 to 80% by weight, more preferably 40 to 70% by weight, on a solid basis.

Organic fine particles such as polyethylene wax, inorganic fine particles or the like may be incorporated into the black dye layer from the viewpoint of regulating the coatability and preventing fusing of the dye layer to the image-receiving sheet.

Further, an anti-tack layer, that is, a release layer, may be provided on the black dye layer. The release layer may be formed by depositing an anti-tack inorganic powder or formed of a resin having good releasability, such as a silicone polymer, an acrylic polymer, or fluoropolymer. In this connection, it should be noted that such materials having good release effect can provide a good effect when they are incorporated into the dye layer.

Next, the transferable protective layer according to the present invention will be described. When the substrate film per se has poor releasability, it is preferred to previously form a release layer on the surface of the substrate film prior to the formation of the transferable protective layer.

The release layer may be formed by coating a composition containing a material mentioned above as the release agent, such as a wax, silicone wax, silicone resin, fluororesin, acrylic resin, cellulosic resin, vinyl chloride/vinyl acetate copolymer resin, nitrocellulose resin, urethane resin, butyral resin, or acetal resin, for example, by gravure coating, roll coating or other coating means.

A thickness of about 0.01 to 5 $\mu$m suffices for the release layer.

Further, in the present invention, when a matte print or matte protective layer after transfer operation is desired, various inorganic fillers or the like may be incorporated into the release layer to render the surface of the release layer matte.

Further, a fluorescent brightening agent, an ultraviolet absorber or the like may be added to enable the formation of the release layer to be confirmed.

In the present invention, when the substrate film per se has satisfactory releasability, the transferable protective layer may be formed directly on the surface of the substrate film.

In the present invention, the transferable protective layer provided on the substrate film or the release layer is transferred onto the printed image to protect the printed image.

Therefore, the transferable protective layer may be constituted, for example, by a coating containing a resin having excellent transparency, abrasion resistance, chemical resistance, light fastness, weather resistance and other various types of fastness, such as acrylic resin, polyester resin, polyurethane resin, epoxy resin, vinyl chloride, vinyl chloride/vinyl acetate copolymer resin, or polyamide resin.

The transferable protective layer may be formed by preparing a composition composed mainly of the above resin and coating the composition by conventional coating, printing or other method as described above in connection with the formation of the black dye layer to form a layer having a thickness of, for example, about 0.2 to 10 $\mu$m.

In the formation of the protective layer, in order to improve the layer transferability at the time of thermal transfer, an inorganic filler, such as silica alumina, may be added to the composition in such an amount as will not be detrimental to the transparency.

Further, a wax, such as a polyethylene wax, may be added to the composition for forming the protective layer from the viewpoint of imparting abrasion resistance, slip property and the like.

Furthermore, a fluorescent brightening agent, an ultraviolet absorber or the like may be added to enable the formation of the transferable protective layer to be confirmed.

In the present invention, in order to ensure intimate contact of the protective layer with the printed image layer after the transfer of the transferable protective layer, an adhesive layer may be provided on the transferable protective layer.

The adhesive layer may be formed, for example, by coating an adhesive composition composed mainly of acrylic resin, vinyl chloride resin, vinyl chloride/vinyl acetate copolymer resin, polyester resin, polyurethane resin, epoxy resin, styrene resin or the like by conventional coating, printing or other method and drying the coating.

The thickness of the adhesive layer is preferably in the rage of from about 0.1 to 10 $\mu$m.

Further, a fluorescent brightening agent, an ultraviolet absorber or the like may be added to enable the formation of the adhesive layer to be confirmed.

In the present invention, the function of the protective layer can be further enhanced by incorporating particularly the following reactive ultraviolet absorber into the transferable protective layer or by providing an additional layer containing the reactive ultraviolet absorber on either of or both the upper surface or lower surface of the transferable protective layer. Therefore, this is very advantageous.

Specifically, reactive ultraviolet absorbers usable in the present invention include those prepared by introducing, for example, an addition polymerizable double bond, such as a vinyl, acryloyl, or methacryloyl group, or alcoholic hydroxyl, amino, carboxyl, epoxy, or isocyanate group into a conventional organic ultraviolet absorber, that is, a salicylate, benzophenone, benzotriazole, substituted acrylonitrile, nickel chelate, or hindered amine or other nonreactive ultraviolet absorber. For example, reactive ultraviolet absorbers represented by the following structural formulae (30) and (31) may be mentioned as specific examples of preferred reactive ultraviolet absorbers.

However, the reactive ultraviolet absorbers usable herein are not limited to these compound only.

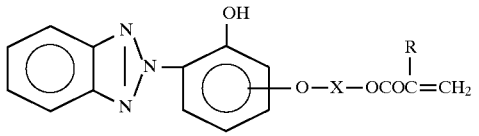

(30)

wherein R represents H or $CH_3$ and X represents —$CH_2CH_2$— or $$-CH_2\underset{\underset{OH}{|}}{C}HCH_2-;\ \text{and}$$

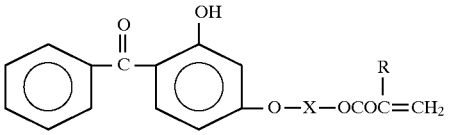

(31)

wherein R represents H or $CH_3$ and X represents —$CH_2CH_2$— or $$-CH_2\underset{\underset{OH}{|}}{C}HCH_2-.$$

In the present invention, the incorporation of the reactive ultraviolet absorber into the transferable protective layer or the provision of the additional layer containing the ultraviolet absorber may be performed by various methods.

For example, a copolymer may be prepared by free radical polymerization of a resin component, such as a conventional a monomer, oligomer, or reactive polymer, with the reactive ultraviolet absorber. In this case, reactive ultraviolet absorbers, having an addition-polymerizable double bond, represented by the structural formulae (30) and (31) are preferably used as the reactive ultraviolet absorber.

When the reactive ultraviolet absorber has a group such as a hydroxyl, amino, carboxyl, epoxy, or isocyanate group, a thermoplastic resin having a functional group reactive with the above reactive group is used and reacted with the reactive ultraviolet absorber optionally in the presence of a catalyst by taking advantage of heat or the like to fix the reactive ultraviolet absorber to the thermoplastic resin.

According to the present invention, the reactive ultraviolet absorber may be incorporated into the transferable protective layer by copolymerizing the above reactive ultraviolet absorber with the resin component, such as a monomer, an oligomer, or a reactive polymer to prepare a polymer having a capability of absorbing ultraviolet light, adding the polymer to a composition for constituting a transferable protective layer, and forming a film using the composition by conventional coating, printing or other method to form a transferable protective layer.

Alternatively, a layer containing an ultraviolet absorber may be additionally formed by preparing a composition using the above polymer having a capability of absorbing ultraviolet light either alone or a combination of the polymer with other resin vehicle and forming a coating of the composition on either of or both the upper surface or lower surface of the transferable protective layer by conventional coating or printing method.

Monomer components which may be used for copolymerization with the reactive ultraviolet absorber include:

methyl acrylate, methyl methacrylate, ethyl acrylate, ethyl methacrylate, propyl acrylate, propyl methacrylate, butyl acrylate, butyl methacrylate, isobutyl acrylate, isobutyl methacrylate, tert-butyl acrylate, tert-butyl methacrylate, isodecyl acrylate, isodecyl methacrylate, lauryl acrylate, lauryl methacrylate, lauryl tridecyl acrylate, lauryl tridecyl methacrylate, tridecyl acrylate, tridecyl methacrylate, cerylstearyl acrylate, cerylstearyl methacrylate, stearyl acrylate, stearyl methacrylate, ethylhexyl acrylate, ethylhexyl methacrylate, octyl acrylate, octyl methacrylate, cyclohexyl acrylate, cyclohexyl methacrylate, benzyl acrylate, benzyl methacrylate, methacrylic acid, hydroxyethyl acrylate, hydroxyethyl methacrylate, hydroxypropyl acrylate, hydroxypropyl methacrylate, dimethylaminoethyl acrylate, dimethylaminoethyl methacrylate, diethylaminoethyl acrylate, diethylaminoethyl methacrylate, tert-butylaminoethyl acrylate, tert-butylaminoethyl methacrylate, glycidyl acrylate, glycidyl methacrylate, tetrahydrofurfuryl acrylate, and tetrahydrofurfuryl methacrylate.

Further examples thereof include ethylene diacrylate, ethylene dimethacrylate, diethylene glycol diacrylate, diethylene glycol dimethacrylate, triethylene glycol diacrylate, triethylene glycol dimethacrylate, tetraethylene glycol diacrylate, tetraethylene glycol dimethacrylate, decaethylene glycol diacrylate, decaethylene glycol dimethacrylate, pentadecaethylene glycol diacrylate, pentadecaethylene glycol dimethacrylate, pentacontahectaethylene glycol diacrylate, pentacontahectaethylene glycol dimethacrylate, butylene diacrylate, butylene dimethacrylate, allyl acrylate, allyl methacrylate, trimethylol propane triacrylate, trimethylol propane trimethacrylate, hexanediol diacrylate, hexanediol dimethacrylate, tripropylene glycol diacrylate, tripropylene glycol dimethacrylate, pentaerythritol tetraacrylate, pentaerythritol tetramethacrylate, dipentaerythritol hexaacrylate, dipentaerythritol hexamethacrylate, 1,6-hexanediol diacrylate, 1,6-hexanediol dimethacrylate, neopentyl glycol pentaacrylate, neopentyl glycol pentamethacrylate, phosphagen hexaacrylate, and phosphagen hexamethacrylate.

The above compounds may also be used as an oligomer. It is also possible to use acrylic reactive polymers constituted by polymers or their derivative, such as polyester acrylate, epoxy acrylate, urethane acrylate, and polyether acrylate.

These monomers, oligomers, and acrylic reactive polymers may be used alone or as a mixture of two or more.

As described above, a thermoplastic copolymer resin with a reactive ultraviolet absorber chemically bonded thereto may be prepared by copolymerizing a monomer or an oligomer of a thermoplastic resin or an acrylic reactive polymer with a reactive ultraviolet absorber. The content of the reactive ultraviolet absorber in the copolymer resin is preferably in the range of from 10 to 90% by weight, particularly preferably in the range of from 30 to 70% by weight. When the content is less than 10% by weight, it is difficult to provide satisfactory light fastness. On the other hand, when it exceeds 90% by weight, problems occur such as sticking at the time of coating and bleeding of the image at the time of the transfer onto the dye image.

The molecular weight of the copolymer resin is preferably in the range of form about 5,000 to 250,000, particularly preferably about 9,000 to 30,000. When the molecular weight is less than 5,000, the coating strength is so low that durability required of the protective layer cannot be ensured. On the other hand, when it exceeds 250,000, the layer transferability or the like is unfavorably deteriorated at the time of transfer of the protective layer by means of a thermal head or the like.

One example of the structural formula of the thermoplastic copolymer resin copolymerized with the reactive ultraviolet absorber is represented by the following formula (32). However, it is a matter of course that the thermoplastic copolymer resin copolymerized with the reactive ultraviolet absorber is not limited to those represented by the formula (32).

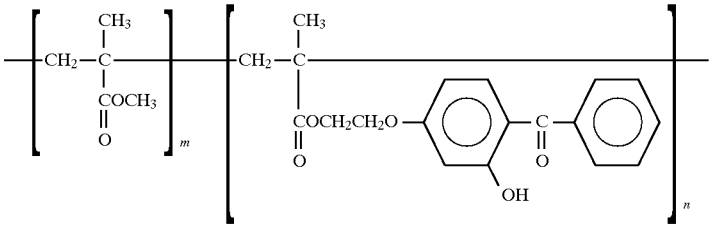

(32)

wherein m and n are each 10 to 90% to form the copolymer.

Further, according to the present invention, in the above thermal transfer sheet, a heat-resistant layer may be provided on the back surface thereof in order to avoid adverse effect of heat from the thermal head.

The heat-resistant layer may be formed of, for example, a reaction product, of polyvinyl butyral with an isocyanate, containing a surfactant, such as an alkali metal salt or an alkaline earth metal salt of a phosphoric ester, and a filler, such as talc.

The thermal transfer sheet according to the present invention is as described above. However, the above embodiments have been given for illustrative purpose only, and the present invention is not limited to thereto.

In the present invention, the order of the formation of the black dye layer, the transferable protective layer and the like is not particularly limited.

The thermal transfer method using the above thermal transfer sheet according to the present invention will be described.

Printing of letters, marks and the like on the surface of a card will now be described as an example. In this printing, at the outset, the surface of a black dye layer of the above thermal transfer sheet is brought into contact with the surface of a card substrate, and heat is applied to the back surface of the thermal transfer sheet based on image information by means of a thermal head of a printer to print a desired letter, mark or the like.

Further, the surface of a transferable protective layer of the thermal transfer sheet is put on top of the surface of the printed image, and the transferable protective layer is thermally transferred to prepare a card as the thermally transferred product of the present invention.

In the present invention, it is also possible to use a method which comprises previously forming an image corresponding to a photograph of a face on a card substrate, for example, by the sublimation type thermal transfer system and transferring the transferable protective layer onto both the photograph-like image of a face and an image of a letter, a mark or the like to form a protective layer on both the images.

In the above thermal transfer, an identical printer may be used for the transfer of both the black dye layer and the transferable protective layer. Alternatively, the transfer of the black dye layer and the transfer of the transferable protective layer may be conducted using respective different printers. The printing energy may be regulated as desired.

Although the transfer method has been described above with respect to the use of a card, other objects may also used as the image-receiving sheet. In the present invention, for example, polyester sheets, polyvinyl chloride sheets and other various resin sheets, papers, and woven fabrics and nonwoven fabrics of polyester fibers, polyamide fibers, polypropylene fibers, vinylon fibers, and other various fibers may be used as the image-receiving sheet.

In the present invention, the most preferred substrate is a card substrate made of a polyester, polyvinyl chloride or the like.

Other images, for example, a photograph-like image of a face by the sublimation type thermal transfer recording system, an emboss, a signature, a magnetic layer, or an IC memory may be previously provided on the card substrate.

The present invention will now be described in more detail with reference to the following examples. In the following examples, all "parts" or "%" are by weight unless otherwise specified.

EXAMPLE 1

A 6.0 μm-thick polyester film, having a 1 μm-thick heat-resistant slip layer on the back surface thereof, with a 0.5 μm-thick primer layer of a polyurethane resin provided on the top surface thereof was provided, and the following ink compositions were coated by gravure coating on the surface of the primer layer of the polyester film each at a coverage on a dry basis of 1.2 g/m$^2$ and in a width of 30 cm, and the coatings were dried to form black dye layers.

Preparation of ink compositions for black dye layers

Sixteen dyes in total, that is, 12 dyes according to the present invention represented by the following respective formulae (Y-1), (Y-2), (Y-3), (M-1), (M-2), (M-3), (M-4), (C-1), (C-2), (C-3), (C-4), and (C-5), and comparative magenta, yellow, and cyan dyes represented by the following respective formulae (M*1), (M*2), (Y*1), and (C*1):

(Y-1)
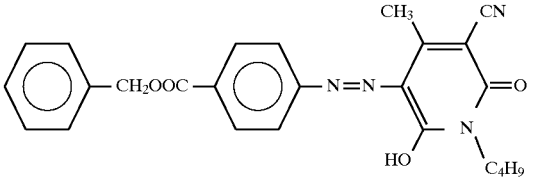
(Y-2)
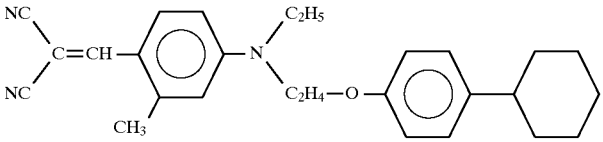
(Y-3)
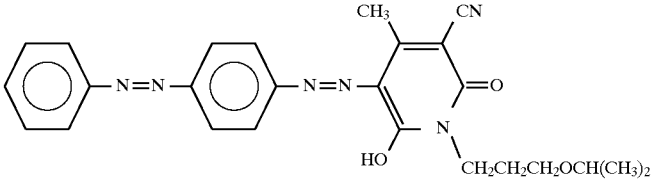
(M-1)
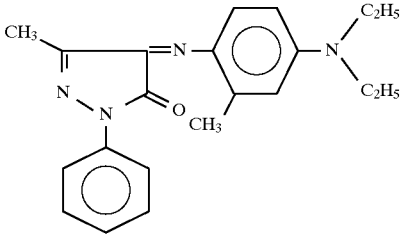
(M-2)
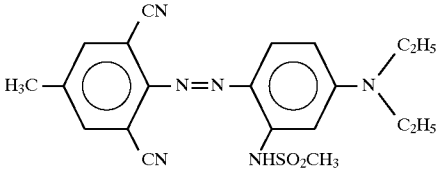
(M-3)
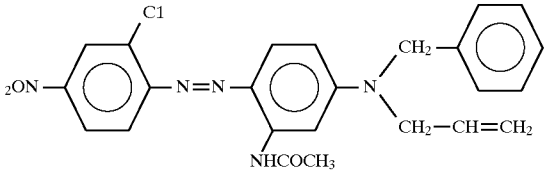
(M-4)
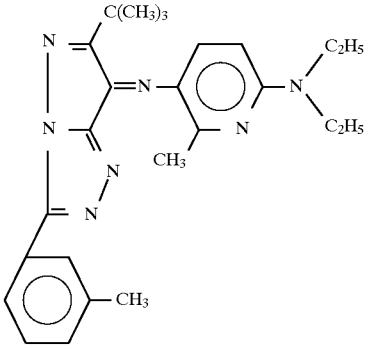
(C-1)
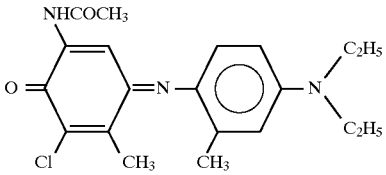

-continued
(C-2)
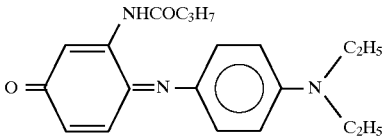
(C-3)
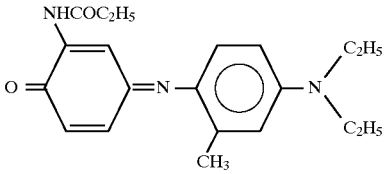
(C-4)
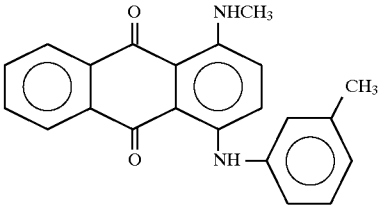
(C-5)
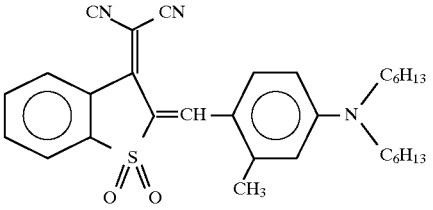
(M*1)
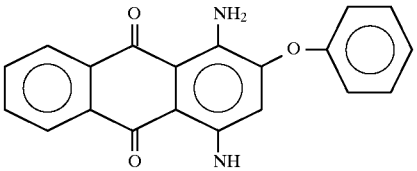
(M*2)
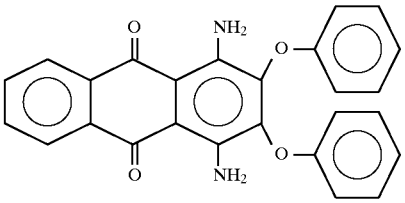
(Y*1)
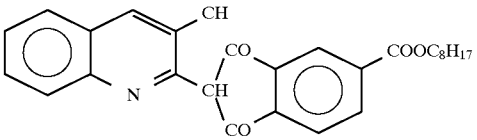
(C*1)
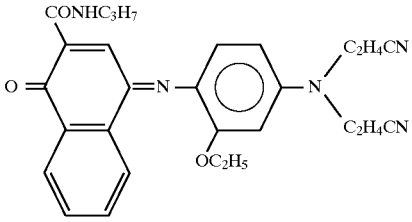
These dyes were suitably combined to prepare ink compositions containing black dyes as indicated in the following Tables 1 to 3.

Numerical values in the tables are in parts by weight.

TABLE 1

Mixing ratio of dyes for preparation of black dyes

| Black dye layer No. | No. 1 | No. 2 | No. 3 | No. 4 | No. 5 |
|---|---|---|---|---|---|
| Dye Y-1 | | | | | |
| Y-2 | 1.75 | 1.10 | 1.26 | | |
| Y-3 | | | | 2.05 | 2.80 |
| M-1 | | | | | 0.80 |
| M-2 | 2.10 | | 0.63 | | |
| M-3 | | 2.15 | | 1.55 | |
| M-4 | | | 0.70 | | |
| C-1 | 2.52 | 3.30 | 3.50 | | |
| C-2 | | | | | 3.40 |
| C-3 | | | | 3.40 | |
| C-4 | | | 0. 91 | | |
| C-5 | 0.63 | 0.45 | | | |

TABLE 2

Mixing ratio of dyes for preparation of black dyes

| Black dye layer No. | No. 6 | No. 7 | No. 8 | No. 9 | No. 10 |
|---|---|---|---|---|---|
| Dye Y-1 | | 1.60 | | | |
| Y-2 | 1.43 | | 0.38 | 1.42 | 2.00 |
| Y-3 | | 1.40 | 1.20 | 1.41 | |
| M-1 | | | | 1.50 | |
| M-2 | 1.43 | | 1.12 | | |
| M-3 | | | | | |
| M-4 | | 1.40 | | | 2.10 |
| C-1 | | 1.60 | 1.05 | | 2.10 |
| C-2 | | 1.50 | | 1.67 | |
| C-3 | | | | 1.50 | |
| C-4 | 4.64 | | 3.75 | | |
| C-5 | | | | | 1.50 |

TABLE 3

Mixing ratio of dyes for preparation of black dyes

| Black dye layer No. | No. 11 | No. 12 | No. 13 Comp. Ex. | No. 14 |
|---|---|---|---|---|
| Dye Y-1 | | 1.40 | | |
| Y-2 | 1.40 | | | 1.20 |
| Y-3 | | | | |
| M-1 | | | | |
| M-2 | | | 1.60 | |
| M-3 | | | | |
| M-4 | 1.40 | | | 1.20 |
| C-1 | 0.50 | | | |
| C-2 | | | | |
| C-3 | | | | |
| C-4 | 4.40 | 4.00 | 4.00 | |
| C-5 | | | | |
| M*1 | | 1.30 | | |
| M*2 | | 1.30 | | |
| Y*1 | | | 2.40 | |
| C*1 | | | | 5.60 |

Black dyes thus prepared and a polyvinyl acetoacetal resin as a binder, and toluene and methyl ethyl ketone as a solvent were used to prepare ink compositions for forming black dye layers according to the following formulations.

Ink compositions 1 to 5 for black dye layer

| | |
|---|---|
| Black dye Nos. 1 to 5 (Table 1) | 7.00 parts |
| Polyvinyl acetoacetal resin (S-lec KS-5, manufactured by Sekisui Chemical Co., Ltd.) | 3.50 parts |
| Toluene | 44.75 parts |
| Methyl ethyl ketone | 44.75 parts |

| | |
|---|---|
| Black dye Nos. 6 to 9 (Table 2) | 7.50 parts |
| Polyvinyl acetoacetal resin (S-lec KS-5, manufactured by Sekisui Chemical Co., Ltd.) | 3.50 parts |
| Toluene | 44.50 parts |
| Methyl ethyl ketone | 44.50 parts |

Ink compositions 10 to 11 for black dye layer

| | |
|---|---|
| Black dye Nos. 10 to 11 (Tables 2 and 3) | 7.70 parts |
| Polyvinyl acetoacetal resin (S-lec KS-5, manufactured by Sekisui Chemical Co., Ltd.) | 3.50 parts |
| Toluene | 44.40 parts |
| Methyl ethyl ketone | 44.40 parts |

Ink compositions 12 to 14 for black dye layer

| | |
|---|---|
| Black dye Nos. 12 to 14 (Table 3) | 8.00 parts |
| Polyvinyl acetoacetal resin (S-lec KS-5, manufactured by Sekisui Chemical Co., Ltd.) | 3.50 parts |
| Toluene | 44.25 parts |
| Methyl ethyl ketone | 44.25 parts |

Then, the following ink was coated in each non-black dye layer portion (width 60 cm) of each of the substrate films at a coverage on a solid basis of 1 g/m$^2$, and the coating was dried to form a transferable protective layer.

(Ink composition for protective layer)

| | |
|---|---|
| Acrylic resin | 77 parts |
| Vinyl chloride/vinyl acetate copolymer resin | 19 parts |
| Polyethylene wax | 3.5 parts |
| Polyester resin | 0.5 part |
| Fluorescent brightening agent | 0.5 part |
| Toluene | 250 parts |
| Methyl ethyl ketone | 250 parts |

The following ink was coated at a coverage on a solid basis of 3 g/m$^2$ on the surface of the transferable protective layer formed on each substrate film, and the coating was then dried to prepare an adhesive layer, thereby preparing thermal transfer sheets of the present invention.

(Ink composition for adhesive layer)

| | |
|---|---|
| Vinyl chloride/vinyl acetate copolymer resin | 10 parts |
| Fluorescent brightening agent | 0.05 part |
| Toluene | 100 parts |
| Methyl ethyl ketone | 100 parts |

Each of the thermal transfer sheets thus obtained was put on the surface of a card substrate formed of 100 parts of a polyvinyl chloride (degree of polymerization: 800) containing about 10% of an additive, such as a stabilizer, 10 parts of titanium oxide, and 0.5 part of a plasticizer so that the surface of the black dye layer faced the surface of the card substrate. Heat was applied through the back surface by means of a thermal head to print a monochrome photograph-like image of a face, and the transferable protective layer of the thermal transfer sheet was transferred onto the image area in the same manner as described above to prepare cards having images of a face corresponding to the respective thermal transfer sheets.

The surface of the cards was rubbed with a gauze impregnated with isopropyl alcohol 100 times. As a result, none of the cards stained the gauze. By contrast, cards with no protective layer transferred thereon remarkably stained the gauze.

EXAMPLE 2

A black ink composition A for a black dye layer was prepared according to the following formulation instead of the ink compositions 1 to 5 for a black dye layer in Example 1.

Ink compositions 1 to 5 for black dye layer

| | |
|---|---|
| Black dye Nos. 1 to 5 (Table 1) | 7.00 parts |
| Polyvinyl acetoacetal resin | 3.00 parts |
| Silicone graft polyvinyl | 0.50 part |

-continued

| | |
|---|---|
| acetoacetal resin | |
| Polyethylene wax | 0.20 part |
| Methyl ethyl ketone/toluene (1/1) | 89.50 parts |

Separately, a black ink composition B for a black dye layer was prepared according to the following formulation instead of the ink compositions 1 to 5 for a black dye layer in Example 1.

Ink compositions 1 to 5 for black dye layer

| | |
|---|---|
| Black dye Nos. 1 to 5 (Table 1) | 7.00 parts |
| Polyvinyl acetoacetal resin | 3.50 parts |
| Polyethylene wax | 0.20 part |
| Methyl ethyl ketone/toluene (1/1) | 89.50 parts |

In the same manner as in Example 1, the black ink composition A and the black ink composition B were coated on a substrate each at a coverage of 0.5 g/m$^2$ so that the coating of the composition A was put on top of the coating of the composition B, and the coatings were dried to form a black dye layer having a two-layer structure.

The other conditions were the same as those in Example 1, thereby preparing a card with an image of a face printed thereon according to the present invention. This card had the same effect as attained in Example 1.

EXAMPLE 3

The procedure of Example 1 was repeated, except that an ultraviolet screening layer formed using the following composition was provided between the transferable protective layer and the adhesive layer in the thermal transfer sheet of Example 1.

Ink composition for ultraviolet screening layer

| | |
|---|---|
| Copolymer resin with reactive ultraviolet absorber represented by the following formula (33) reaction-bonded thereto | 20.00 parts |
| Ethyl acetate | 80.00 parts |

After the formation of the transferable protective layer, the above composition was coated on the transferable protective layer at a coverage of 1 g/m$^2$, and the coating was dried to form an ultraviolet screening layer.

Thereafter, an adhesive layer was formed on the ultraviolet screening layer in the same manner as in Example 1, thereby preparing a thermal transfer sheet of the present invention.

The other conditions were the same as those in Example 1, thereby preparing a card with an image of a face printed thereon according to the present invention. This card had the same effect as attained in Example 1.

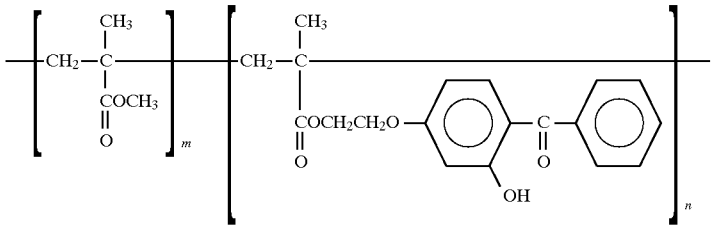

(33)

wherein m and n each represent a weight ratio in the copolymer with m: n=5:5.

As is apparent from the above result, since the black dye layer in the thermal transfer sheet according to the present invention contains a dye having a black hue, prepared by selecting specific dyes and mixing them together, it has good sensitivity in recording, can develop a black color having a high density, and can form thermally transferred images, such as letters, marks, figures or images of faces, which are very clear and sharp and has excellent durability, various types of fastness and other properties.

What is claimed is:

1. A thermal transfer sheet comprising: a substrate film; and a sublimable black dye layer and a transferable protective layer provided on the substrate film in a face serial manner.

2. The thermal transfer sheet according to claim 1, wherein the sublimable black dye layer comprises at least one yellow dye selected from the group consisting of yellow dyes represented by the following general formulae (1), (2), and (3), at least one magenta dye selected from the group consisting of magenta dyes represented by the following general formulae (4), (5) and (6), and at least one cyan dye selected from the group consisting of cyan dyes represented by the following general formulae (7), (8), and (9):

(1)

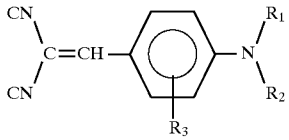

(2)

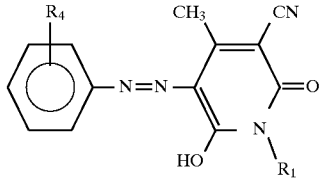

(3)

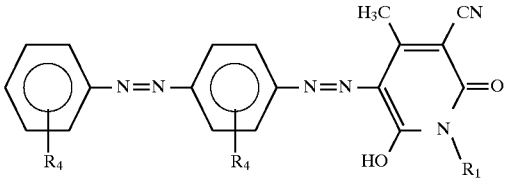

(4)

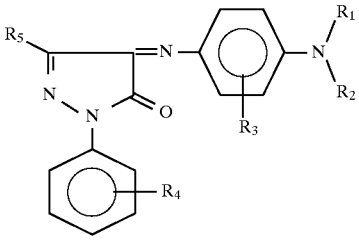

(5)

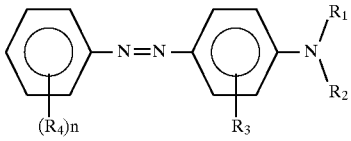

(n is an integer of 3 or less)

(6)

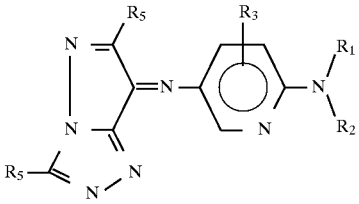

(7)

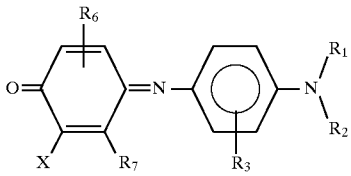

-continued (8)

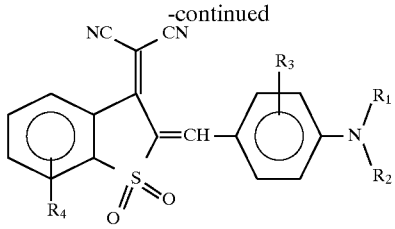

(9)

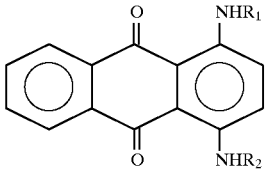

wherein $R_1$ and $R_2$ represent a substituted or unsubstituted alkyl, substituted or unsubstituted allyl, substituted or unsubstituted aryl, substituted or unsubstituted cycloalkyl, substituted or unsubstituted aralkyl, or substituted or unsubstituted alkoxyalkyl group, $R_3$ represents a substituted or unsubstituted alkyl, substituted or unsubstituted alkoxy, substituted or unsubstituted alkylcarbonylamino, substituted or unsubstituted alkylsulfonylamino, substituted or unsubstituted alkylaminocarbonyl, cyano, or nitro group or a halogen or hydrogen atom, $R_4$ represents a substituted or unsubstituted alkyl, substituted or unsubstituted aralkyl oxycarbonyl, substituted or unsubstituted alkoxycarbonyl, substituted or unsubstituted alkylaminocarbonyl, substituted or unsubstituted alkoxy, substituted or unsubstituted alkylaminosulfonyl, substituted or unsubstituted cycloalkyl, cyano, or nitro group or a halogen atom, $R_5$ represents a substituted or unsubstituted alkyl, substituted or unsubstituted aryl, substituted or unsubstituted amino, substituted or unsubstituted cycloalkyl, cyano, or nitro group or a halogen or hydrogen atom, $R_6$ represents a substituted or unsubstituted alkylaminocarbonyl, substituted or unsubstituted alkylaminosulfonyl, substituted or unsubstituted alkylcarbonylamino, or substituted or unsubstituted alkylsulfonylamino group or a halogen atom, $R_7$ represents a substituted or unsubstituted alkyl group, and X represents a halogen atom.

3. The thermal transfer sheet according to claim 1, wherein the sublimable black dye layer comprises at least one yellow dye selected from the group consisting of yellow dyes Y-1, Y-2, and Y-3 represented by the following respective formulae, at least one magenta dye selected from the group consisting of magenta dyes M-1, M-2, M-3, and M-4 represented by the following respective formulae, and at least one cyan dye selected from the group consisting of cyan dyes C-1, C-2, C-3, C-4, and C-5 represented by the following respective formulae:

Y-1 (C.I. Disperse Yellow 231)
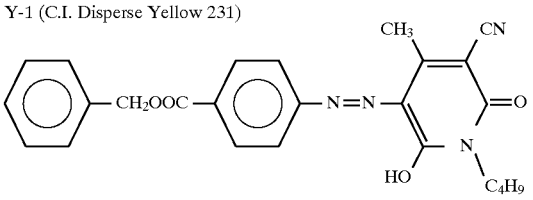
Y-2 (C.I. Disperse Yellow 201)
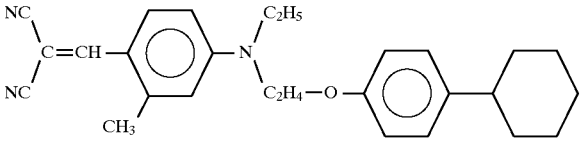
Y-3 (C.I. Disperse Orange 149)
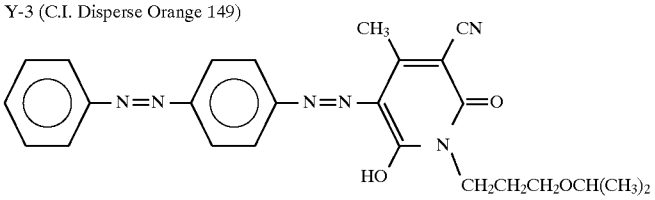
M-1 (Cas. No. 118914-87-7)
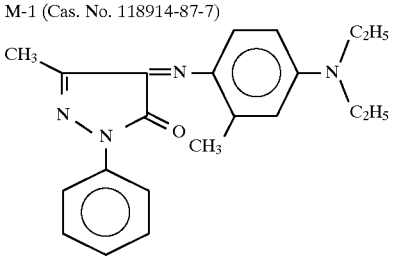
M-2
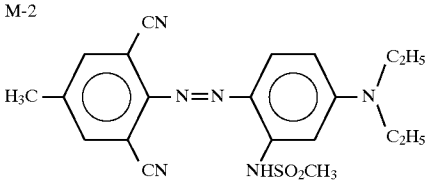
M-3
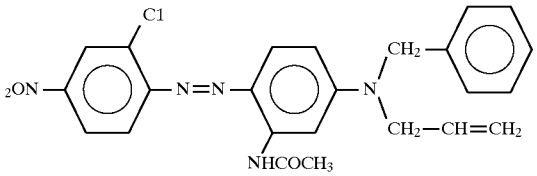
M-4
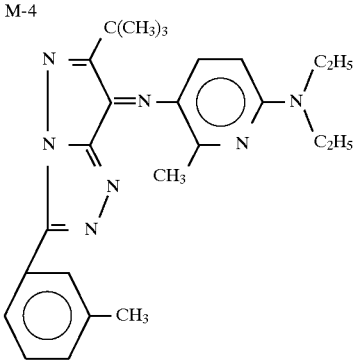

-continued

C-1

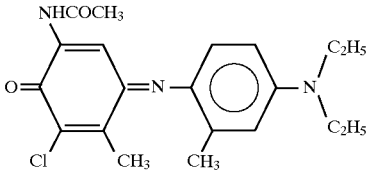

C-2 (Cas. No. 121187-07-3)

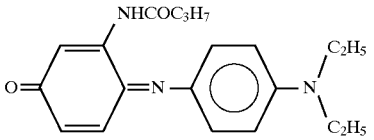

C-3 (Cas. No. 113415-82-0)

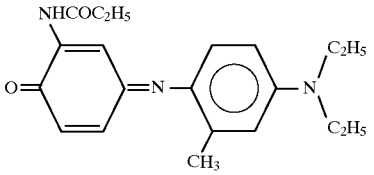

C-4 (C.I. Solvent Blue 63)

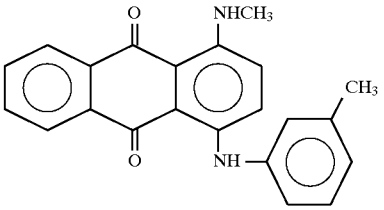

C-5 (C.I. Disperse Blue 354)

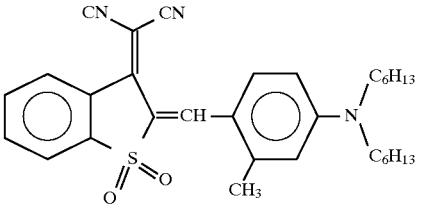

4. The thermal transfer sheet according to claim 1, wherein the sublimable black dye layer comprises 10 to 40% by weight of the yellow dye, 10 to 40% by weight of the magenta dye, and 40 to 70% by weight of the cyan dye.

5. The thermal transfer sheet according to claim 1, wherein the transferable protective layer comprises a release layer, a protective layer, and an adhesive layer in that order.

6. The thermal transfer sheet according to claim 1, wherein a release layer is provided between the substrate film and the protective layer.

7. The thermal transfer sheet according to claim 1, wherein an adhesive layer is provided on the protective layer.

8. A thermal transfer method comprising the steps of: superposing an image receiving sheet with a thermal transfer sheet comprising a substrate film and a sublimable black dye layer and a transferable protective layer provided side by side on the substrate film so that the surface of the sublimable black dye layer faces the image-receiving sheet; applying heat based on image information through the back surface of the thermal transfer sheet to form an image on the image-receiving sheet; superposing the thermal transfer sheet with the surface of the image so that the surface of the image faces the surface of the transferable protective layer; and applying heat to the back surface of the thermal transfer sheet to transfer the transferable protective layer onto the surface of the image.

9. The method according to claim 8, wherein the sublimable black dye layer comprises at least one yellow dye selected from the group consisting of yellow dyes represented by the following general formulae (1), (2), and (3), at least one magenta dye selected from the group consisting of magenta dyes represented by the following general formulae (4), (5), and (6), and at least one cyan dye selected from the group consisting of cyan dyes represented by the following general formulae (7), (8), and (9):

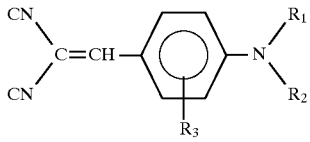

(1)

-continued (2)

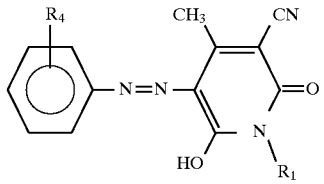

(3)

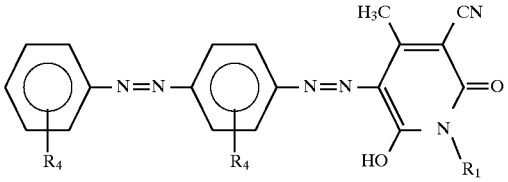

44

(4)

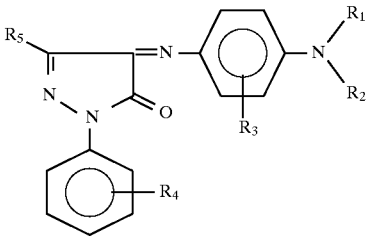

(5)

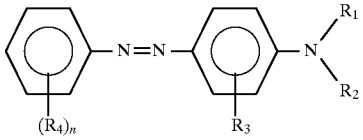

(n is an integer of 3 or less)

(6)

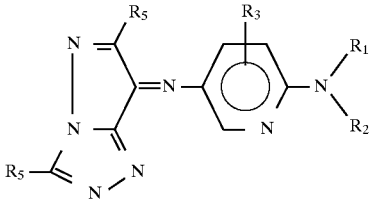

(7)

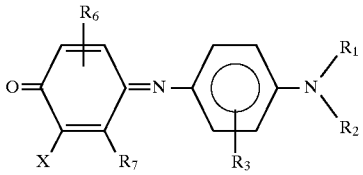

-continued (8)

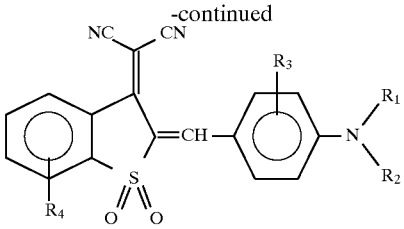

(9)

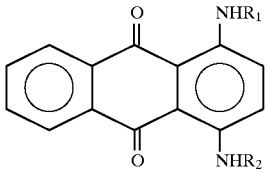

wherein $R_1$ and $R_2$ represent a substituted or unsubstituted alkyl, substituted or unsubstituted allyl, substituted or unsubstituted aryl, substituted or unsubstituted cycloalkyl, substituted or unsubstituted aralkyl, or substituted or unsubstituted alkoxyalkyl group, $R_3$ represents a substituted or unsubstituted alkyl, substituted or unsubstituted alkoxy, substituted or unsubstituted alkylcarbonylamino, substituted or unsubstituted alkylsulfonylamino, substituted or unsubstituted alkylaminocarbonyl, cyano, or nitro group or a halogen or hydrogen atom, $R_4$ represents a substituted or unsubstituted alkyl, substituted or unsubstituted aralkyl oxycarbonyl, substituted or unsubstituted alkoxycarbonyl, substituted or unsubstituted alkylaminocarbonyl, substituted or unsubstituted alkoxy, substituted or unsubstituted alkylaminosulfonyl, substituted or unsubstituted cycloalkyl, cyano, or nitro group or a halogen atom, $R_5$ represents a substituted or unsubstituted alkyl, substituted or unsubstituted aryl, substituted or unsubstituted amino, substituted or unsubstituted cycloalkyl, cyano, or nitro group or a halogen or hydrogen atom, $R_6$ represents a substituted or unsubstituted alkylaminocarbonyl, substituted or unsubstituted alkylaminosulfonyl, substituted or unsubstituted alkylcarbonylamino, or substituted or unsubstituted alkylsulfonylamino group or a halogen atom, $R_7$ represents a substituted or unsubstituted alkyl group, and X represents a halogen atom.

10. A thermally transferred product with a black image, comprising: an image-receiving sheet; a black dye image, of a black dye, provided on the surface of the image-receiving sheet by thermal transfer; and a protective layer provided on the image by thermal transfer.

* * * * *